US006812401B2

(12) United States Patent
Karrmann

(10) Patent No.: US 6,812,401 B2
(45) Date of Patent: Nov. 2, 2004

(54) ULTRA-SMALL HIGH-SPEED COAXIAL CABLE WITH DUAL FILAMENT INSULATOR

(75) Inventor: David E. Karrmann, Washington, NH (US)

(73) Assignee: Temp-Flex Cable, Inc., South Grafton, MA (US)

( * ) Notice: Subject to any disclaimer, the term of this patent is extended or adjusted under 35 U.S.C. 154(b) by 0 days.

(21) Appl. No.: 10/771,830

(22) Filed: Feb. 4, 2004

(65) Prior Publication Data

US 2004/0173367 A1 Sep. 9, 2004

Related U.S. Application Data

(63) Continuation-in-part of application No. 10/376,140, filed on Feb. 28, 2003, now abandoned, which is a continuation of application No. 09/945,576, filed on Aug. 31, 2001, now abandoned, which is a continuation of application No. 09/369,259, filed on Aug. 9, 1999, now abandoned.

(60) Provisional application No. 60/103,025, filed on Oct. 5, 1998.

(51) Int. Cl.[7] ..... H01B 11/18

(52) U.S. Cl. ..... 174/28; 174/113 C; 174/131 A

(58) Field of Search ..... 174/28, 113 R, 174/113 C, 131 A, 29, 116

(56) References Cited

U.S. PATENT DOCUMENTS 2,792,442 A * 5/1957 Leon ..... 174/32
3,248,473 A * 4/1966 Buhmann ..... 174/29
5,262,593 A * 11/1993 Madry et al. ..... 174/102 R

* cited by examiner

*Primary Examiner*—Chau N. Nguyen
(74) *Attorney, Agent, or Firm*—Donald S. Holland, Esq.; Holland & Bonzagni, P.C.

(57) ABSTRACT

A cable for transmitting electromagnetic signals has a central conductor. A pair of insulator filaments, each having a circular cross section, are twisted around each other to form an insulator wrap. The insulator wrap is helically wound around the conductor. An insulator sheath, provided as an outer cover for the cable, surrounds the wrapped central conductor and is supported by the insulator wrap. Since the insulator sheath is offset from the conductor, an enclosed air space is formed between the sheath and the conductor in the spaces not occupied by the insulator wrap. The twist pitch of the filaments and the pitch of the wrap around the conductor can both be modified to adjust the amount of insulator material located in the air space and thereby the cable's effective dielectric constant, which effects the propagation speed of the electromagnetic signals carried by the cable.

10 Claims, 9 Drawing Sheets

ULTRA-SMALL HIGH-SPEED COAXIAL CABLE WITH DUAL FILAMENT INSULATOR

This application is a continuation-in-part of U.S. application Ser. No. 10/376,140, filed Feb. 28, 2003, now abandoned, which is a continuation of U.S. application Ser. No. 09/945,576, filed Aug. 31, 2001, now abandoned, which is a continuation of U.S. application Ser. No. 09/369,259, filed Aug. 9, 1999, now abandoned, which claims the benefit of U.S. Provisional Application No. 60/103,025, filed Oct. 5, 1998.

FIELD OF THE INVENTION

The present invention relates to insulated cables and wires for carrying electromagnetic signals.

BACKGROUND

Although simple, single-strand wire conductors can be used to carry electromagnetic signals, it has long been known that more complex structures or features such as insulators, braided wires, and multiple conductors can be utilized to make connector cables and the like having advanced signal carrying characteristics. This is especially important as the speed and performance requirements of electronic systems continue to dramatically increase. For example, a mere fifteen years ago or so phone service providers only had to worry about a relatively small number of people using 300 baud modems to access remote "bulletin board" services. Now, new computers are capable of transmitting data at 100 or 200 times that rate over standard phone lines (and even more over networks), and the trend to increase speed and performance will likely continue. Cables need to keep pace.

Since multiple signal carrying conductors are often bunched together in one cable bundle, the conductors must also be isolated from one another in order to preserve signal integrity. This is typically accomplished by coating or covering the conductors with some type of insulator. This also protects the conductors from the elements, and, if applicable, reduces the risk of electrical shock. However, because of the nature of electronic signals carried down a conductor (traveling electrons and corresponding electric fields, magnetic fields extending beyond the conductor periphery, etc.), the type and arrangement of insulators surrounding the conductor, as well as the insulators on other, nearby conductors, will have an effect on the signals. One measure of an insulators potential effect on a a conductor's signal characteristics is given by the insulator's dielectric constant, which is roughly an indication of how well a material is capable of storing electric charge. Typically, a low dielectric constant will result in lower cable capacitances, and the insulator will "interact" with the signal less, increasing signal propagation speed and increasing signal efficacy. This is especially true if multiple insulated conductors are grouped together because potential capacitances between the conductors will be reduced, and it is also true with respect to co-axial cables, where the electric and magnetic waves propagate down the space between the co-axial cable's central conductor and outer ground shield.

In order to reduce the dielectric constant of an insulator, it has heretofore been known to use an "insulator system" to cover the conductor. In a single conductor cable, an insulator system is simply some sort of insulator that is more than just a sheath-like covering in direct contact with the conductor. In a co-axial cable, it is something other than just a solid or foamed-support insulator disposed between the central conductor and outer ground shield. Because two or more materials are typically used in an insulator system, such a system has an effective dielectric constant, which is essentially a composite of the dielectric constants of the different materials taking into account mechanical structure and arrangement. Two examples of such a system for co-axial cables are disclosed in Australian Patent 273087 ("AU 273087") accepted Feb. 13, 1967. The first, which is only briefly mentioned in AU 273087, and which is shown in the instant application as FIG. 1 (labeled "Prior Art"), involved wrapping a single plastic or resin strand 24 along the length of the conductor 18 in an open helix or spiral manner. Subsequently, the wrapped conductor was covered by an insulator sheath or tube 20, which contacted the strand 24 instead of the conductor 18 and created an air pocket 22. Thus, the conductor, while still being insulated, was largely surrounded by air, which has a low dielectric constant. However, the effective dielectric constant of this insulator system (insulator strand 24 and sheath 20) was only slightly less than if the sheath was applied directly to the conductor. This is because the relatively large amount of plastic found in the strand (which has a high dielectric constant) partially offset the reduction of the dielectric constant created by the air pocket.

In order to further increase the benefits of the single strand arrangement just described, AU 273087 proposed helically wrapping the conductor with a plurality of stacked and mating rectangular cross section insulators 26, as shown in FIG. 2 of this application (note that the rectangular insulator 26 are not given cross-hatch marks in order to show internal detail). As can be seen, the rectangular insulator 26 were dimensioned to have a height the same as the diameter of the strand 24 in order to sufficiently offset the sheath 20 from the conductor 18. A the same time, the overall amount of plastic found in the air gap 22 was reduced, as shown by comparing the cross-sectional area of the rectangular insulators 26 to the outline 28 of the original strand.

Although the arrangement shown in AU 273087 can be used to reduce the amount of plastic located in the air gap, and therefore the effective dielectric constant of the insulator system, it is disadvantageous for several reasons. First, the stacks of rectangular insulators cannot be used in small cables. For example, as size diminishes, it becomes increasingly more difficult to manufacture and stack the insulators, and to ensure that the insulators are properly wound about the central conductor. With conductors having diameters of 0.015 inch or less, the rectangular stacks of insulators cannot be used without much difficulty and expense, if at all.

Moreover, rectangular insulator stacks are disadvantageous in that the effective dielectric constant of such a system is not adjustable, or only adjustable within a certain range. Specifically, the rectangular insulator stack can theoretically be wound around the central conductor in a tight helix (low pitch), or a loose helix (high pitch). However, in order to ensure structural stability (i.e., proper support for the tubular sheath and outer ground shield, if applicable), the rectangular insulator stack cannot be wound too loosely. Therefore, the effective dielectric constant of the rectangular stack system can be increased (e.g., by winding a tighter helix), but cannot be lowered beyond a minimum value. Although such fine tuning might not have been necessary in the past, for certain applications today (e.g., audio electronics, high speed imaging, computing, radar systems) it is critical.

Accordingly, it is the primary object of this invention to provide an insulator system having a low effective dielectric constant that is still suitable for small cables or conductors.

Another object of the present invention is to further reduce the amount of insulator plastic located between the conductor and the outer insulator sheath, especially in a helically wound insulator system for small cables.

Another object of the present invention is to provide a cable wherein the effective dielectric constant and other characteristics of the insulator system are readily adjustable during manufacturing.

Yet another object of the present invention is to provide a cable wherein the potential for adjusting effective dielectric constant of the insulator system is less constrained by structural stability requirements.

Yet another object of the present invention is to provide a method for adjusting the effective dielectric constant of a signal carrying insulated wire or cable.

Another object of the present invention is to provide a fast co-axial cable having improved structural characteristics and durability.

Another object of the present invention is to provide an improved insulator system, commensurate with the above listed objects, that is easy to manufacture, is inexpensive, and that provides a sturdy covering for a conductor.

SUMMARY

An improved coaxial cable for carrying electromagnetic signals, according to the present invention, comprises a central, signal-carrying conductor, and an insulator wrap helically wound around the central conductor. The insulator wrap is formed from a pair of insulator filaments, each having a circular cross section, which are helically entwined or twisted around each other. An insulator sheath or tube surrounds the wrapped central conductor and is supported by the insulator wrap. Since the sheath is offset from the conductor, an enclosed air space is formed between the sheath and the conductor in the space not occupied by the insulator wrap. A concentric, outer ground shield may be disposed about the insulator sheath to provide a co-axial cable, or the insulator sheath alone may serve as an outer cover for the cable.

Because two filaments are used in the insulator wrap, the outer sheath can be offset well away from the central conductor while minimizing the amount of filament material located between the conductor and the insulator sheath. This reduces the effective dielectric constant of the cable, and thereby improves its signal carrying characteristics. Moreover, because the two filaments are twisted around each other, no insulator stacking is required, and therefore the presently disclosed cable can be made as small as desired while still retaining all the benefits of having a reduced effective dielectric constant.

Also, the insulator system cable of the present invention can be provided with a selected effective dielectric constant (some particular value or a minimum value) during the manufacturing process, even if the cable must meet minimum structural stability standards or requirements. Specifically, both the pitch of the entwined filaments of the wrap itself (the "twist pitch"), and the pitch of the wrap about the conductor (the "wrap pitch"), determine at how many points the insulator sheath is supported by the wrap, and therefore the cable's structural characteristics. Thus, given a cable's structural requirements for a particular application, the insulator system of the present invention, when the twist pitch and the wrap pitch are arranged to minimally meet those requirements (i.e., to provide the minimum number of support points necessary for the particular application), will have the lowest possible effective dielectric constant. Furthermore, both the wrap pitch and the twist pitch can be adjusted up or down, as desired, keeping in mind the overall structural requirements, to vary the effective dielectric constant to some non-minimum value. This is because the effective dielectric constant depends in part on the overall amount of insulator material located between the insulator sheath and the conductor, which is a function of the twist pitch and the wrap pitch. Thus, a manufacturer may precisely adjust the characteristics of the cable (signal speed, etc.), which, as mentioned, is very important for today's electronic devices or applications.

A cable's electrical characteristics are interdependently determined, in part, by component dimensions and variances thereof. Accordingly, to maximize performance for high-speed, high-bandwidth applications, and to produce coaxial cables having characteristic impedances with a very low tolerance of ±1 ohm: (i) the components in the coaxial cable of the present invention are provided according to very close manufacturing tolerances; and (ii) it has been found that the following component dimensions provide a very-fast (propagation speed of 1.14 ns/ft nominal ±0.01 ns/ft for a 50 ohm cable, bandwidth up to 20 GHz), very-small 50 ohm coaxial cable suitable for high bandwidth applications: central conductor=32 AWG–22 AWG; filament diameter=0.0025"–0.010" (±0.00025" tolerance); insulator sheath inner diameter=0.020" to 0.075" (±0.0005" tolerance); insulator sheath wall thickness=0.005" (±0.00025" tolerance).

BRIEF DESCRIPTION OF THE DRAWINGS

These and other features, aspects, and advantages of the present invention will become better understood with respect to the following description, appended claims, and accompanying drawings, in which:

DETAILED DESCRIPTION

Figure 1:
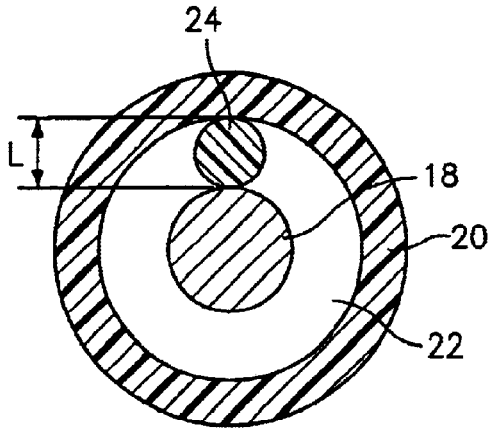
FIG. 1 (PRIOR ART)
FIG. 1 is a cross sectional, top plan view of an insulated conductor according to the prior art.

Turning now to FIGS. 3–8, a preferred embodiment of an insulated cable 10, according to the present invention, will now be given. The cable 10 generally comprises first and second insulator filaments 12, 14 twisted together to form a support wrap 16, the support wrap 16 being helically wound about a central, longitudinal conductor 18 along its length, and the entirety being covered by an insulator sheath 20.

Figure 4:
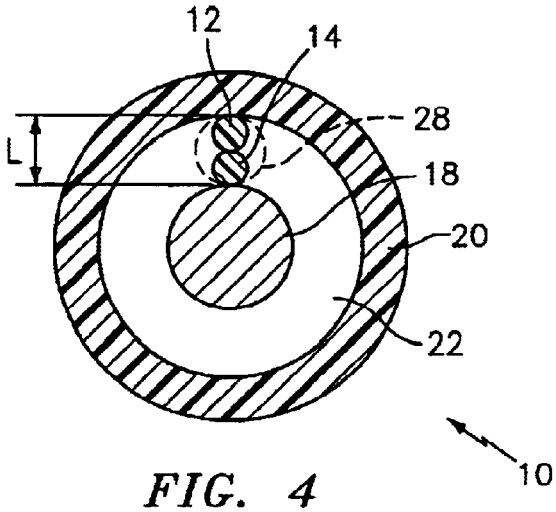
FIG. 4 is a cross sectional, top plan view of the cable of FIG. 3 taken along line 4—4.
Figure 3:
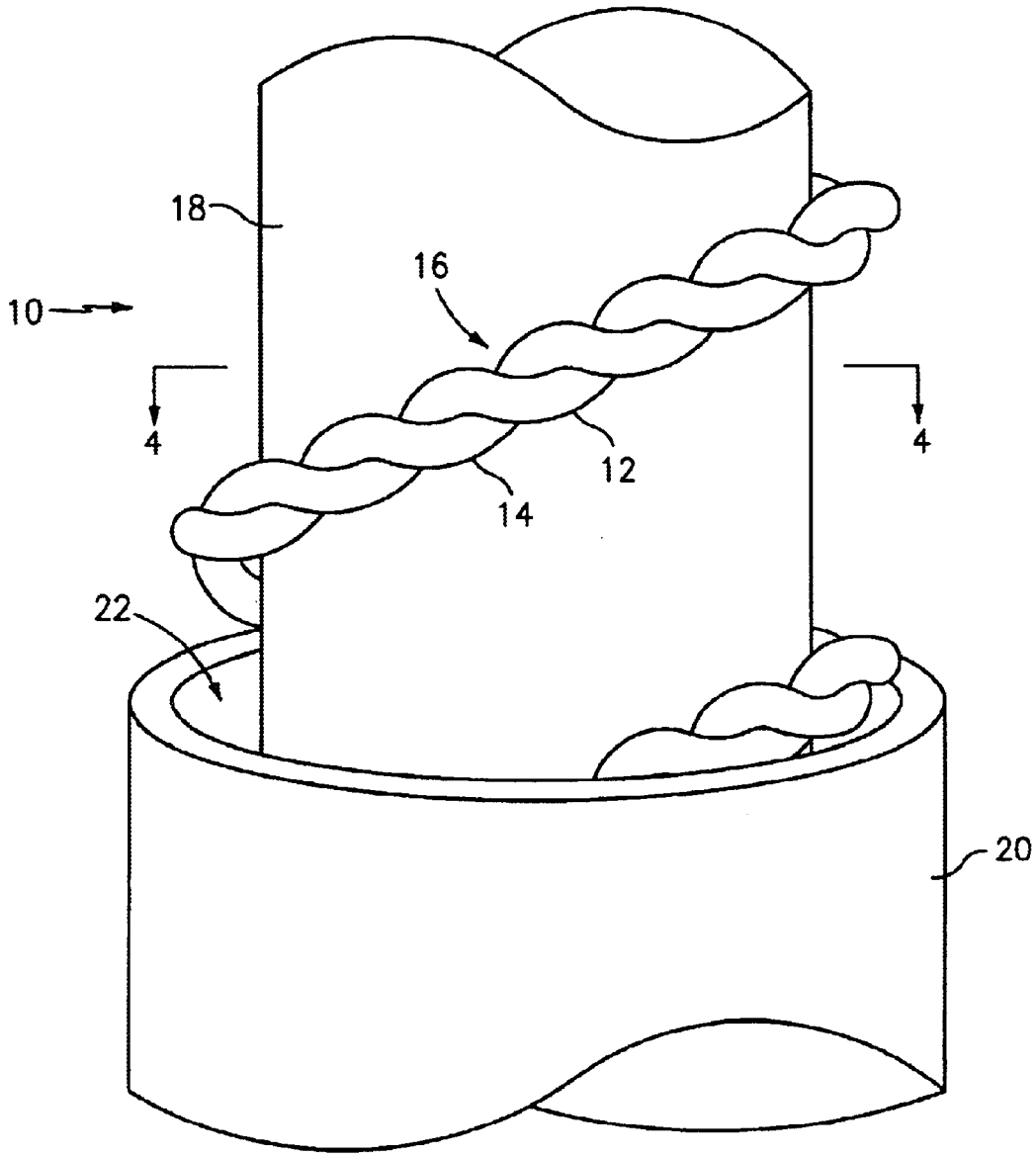
FIG. 3 is a detailed perspective view of a portion of an insulated cable according to the present invention with a section of an insulator sheathing removed to show internal detail.
Figure 9:
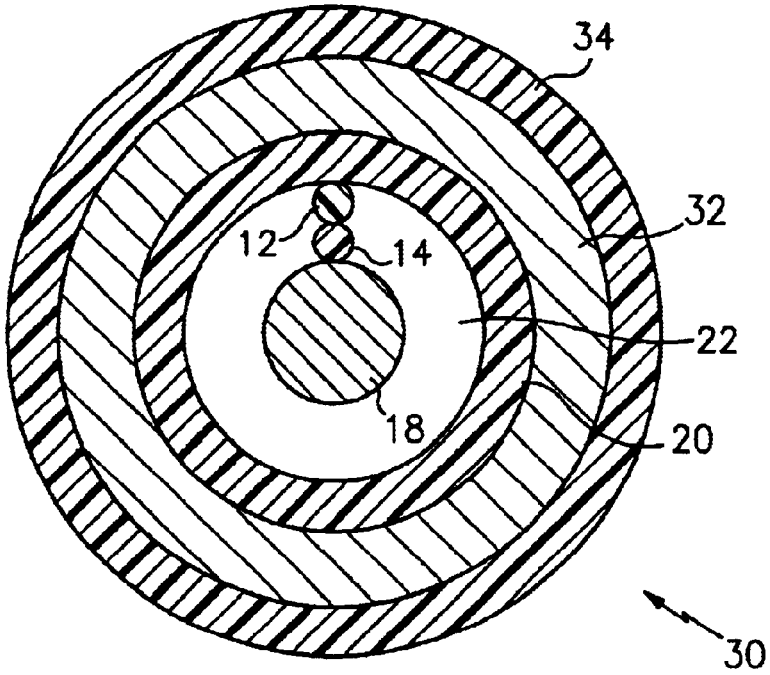
FIG. 9 is a cross sectional, top plan view of a co-axial cable according to the present invention.

As best shown in FIGS. 3 and 4, the insulated cable 10 is capable of transmitting electromagnetic signals via the central, longitudinal conductor or wire 18. As used herein, the term "conductor" refers to any generally longitudinal body well suited to carrying an electromagnetic signal. Thus, the conductor 18 may be composed of any conductive material (e.g., copper) as desired or applicable, and may be a single wire, a bundle of smaller, uninsulated wires, a braided wire, or even multiple insulated wires. For simplicity, the conductor is shown in the figures as a single, solid wire. Also, in order to minimize capacitances and take full advantage of the presently disclosed invention, it is preferable that the conductor have a diameter of no more than 0.015 inch. It should be appreciated, however, that the present invention is applicable to conductors having larger diameters. As shown in FIGS. 4 and 9, the filaments 12, 14 each have a diameter of about one-third the diameter of the conductor 18.

Prior to assembling the cable 10, the first longitudinal insulator filament 12 and the second longitudinal insulator filament 14, both having a circular radial cross section, are helically twisted together to form the insulator wrap 16, as best shown in FIG. 3. Subsequently, the insulator wrap 16 is helically wound around the conductor 18 along the conductor's length. The wrapped conductor is covered by the insulator sheath 20, which is disposed about the wrapped conductor during the manufacturing process in a conventional manner as known by those with skill in the art. The insulator sheath 20 does not contact the conductor 18, but is instead supported and offset from the conductor 18 by the insulator wrap 16. The insulator sheath 20 ensures that the conductor 18 is completely insulated and protected from the elements. Also, as best shown in FIG. 4, because the insulator sheath 20 is supported only by the insulator wrap 16 and does not contact the conductor 18, an air space 22 is formed between the sheath 20 and the conductor 18 in the space not occupied by the wrap 16. The purposes and advantages of this configuration are discussed immediately below.

As previously mentioned, the effective dielectric constant of an insulator system (here, the insulator wrap 16 and the insulator sheath 20) effects the signal carrying characteristics of the conductor, and in particular signal propagation speed. Specifically, the effective dielectric constant is given by:

$$Ee=[Ep\cdot Ef\cdot ln(D/d)]/[Ep\cdot ln(d1/d)+Ef\cdot ln(D/d1)]$$

where

Ee=Effective dielectric constant of the insulator system;
Ep=Dielectric constant of material used to form sheath;
Ef=Effective dielectric constant of insulator wrap and airspace;
ln=Natural log;
D=Outside diameter of sheath;
d=Inside diameter of sheath; and
d=Diameter of conductor.

$$Ef=1+[(Em-1)\cdot K]$$

where

Ef=Effective dielectric constant of insulator wrap and airspace;
Em=Dielectric constant of material used to form insulator wrap; and
K=Ratio of airspace filed by insulator wrap (volume of wrap) to the total airspace (volume of airspace).

As can be seen from these relationships, the effective dielectric constant of the insulator system is directly proportional to the amount of insulator wrap material found in the airspace. Thus, the more the material (or the less the airspace), the greater the effective dielectric constant, and the slower the propagation speed of electromagnetic signals traveling down the conductor.

Referring back to FIG. 4, and comparing it to the prior art shown in FIG. 1, it should be appreciated that using the dual filament wrap 16 of the present invention reduces the overall amount of material in the airspace 22, while still ensuring that the sheath 20 is offset the same distance from the conductor 18. For example, to offset the sheath 20 from the conductor 18 by a distance of L, a single insulator filament 24 may be used having a radial cross-sectional area of $(\pi L_2)/4$. However, if the two filaments 12, 14 are used, the total radial cross-sectional area is $(\pi L_2)/8$, or half.

Figure 2:
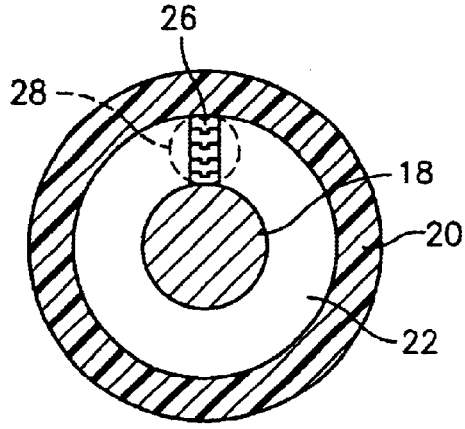
FIG. 2 (PRIOR ART)
FIG. 2 is a cross sectional, top plan view of another insulated conductor according to the prior art.

As discussed above, according to the prior art, a stack of rectangular insulators can be used to offset the sheath from the conductor while minimizing insulator material in the airspace, as shown in FIG. 2. However, also as previously mentioned in the background section, the stacks of rectangular insulators are essentially impossible to use in small cables. The dual filament insulator wrap of the present invention has the reduced material advantage of the rectangular stacks in addition to being usable in small cables. This is because the twisted filaments can be made as small as possible without the need for stacking. That is, the twist of the filaments ensures that the filaments remain together during and subsequent manufacturing.

A further embodiment of the present invention is illustrated in FIG. 9, which shows a co-axial cable 30. The co-axial cable 30, which is generally structurally similar to the cable 10 shown in FIG. 4, further includes a concentric ground shield conductor 32 disposed about the outside of the insulator sheath 20. The ground shield 32 provides a ground or return path for an electromagnetic signal carried by the cable. Additionally, the ground shield 32 may be covered with a concentric, outer insulator jacket 34.

Just as the present invention is efficacious in minimizing the effective dielectric constant of the insulator system, so too is it with respect to providing flexible and accurate dielectric constant adjustment during manufacturing. Specifically, the effective dielectric constant of the cable can be altered by changing the pitch of the filaments 12, 14 twisted together (the twist pitch), or by changing the pitch of the insulator wrap 16 around the conductor 18 (the wrap pitch), because, as shown in the formulas above, the more the insulator material in the air space, the greater the effective dielectric constant. However, in adjusting the pitches, structural limitations and requirements must be considered, as discussed in more detail further below.

Figures 5, 6, 7, 8:
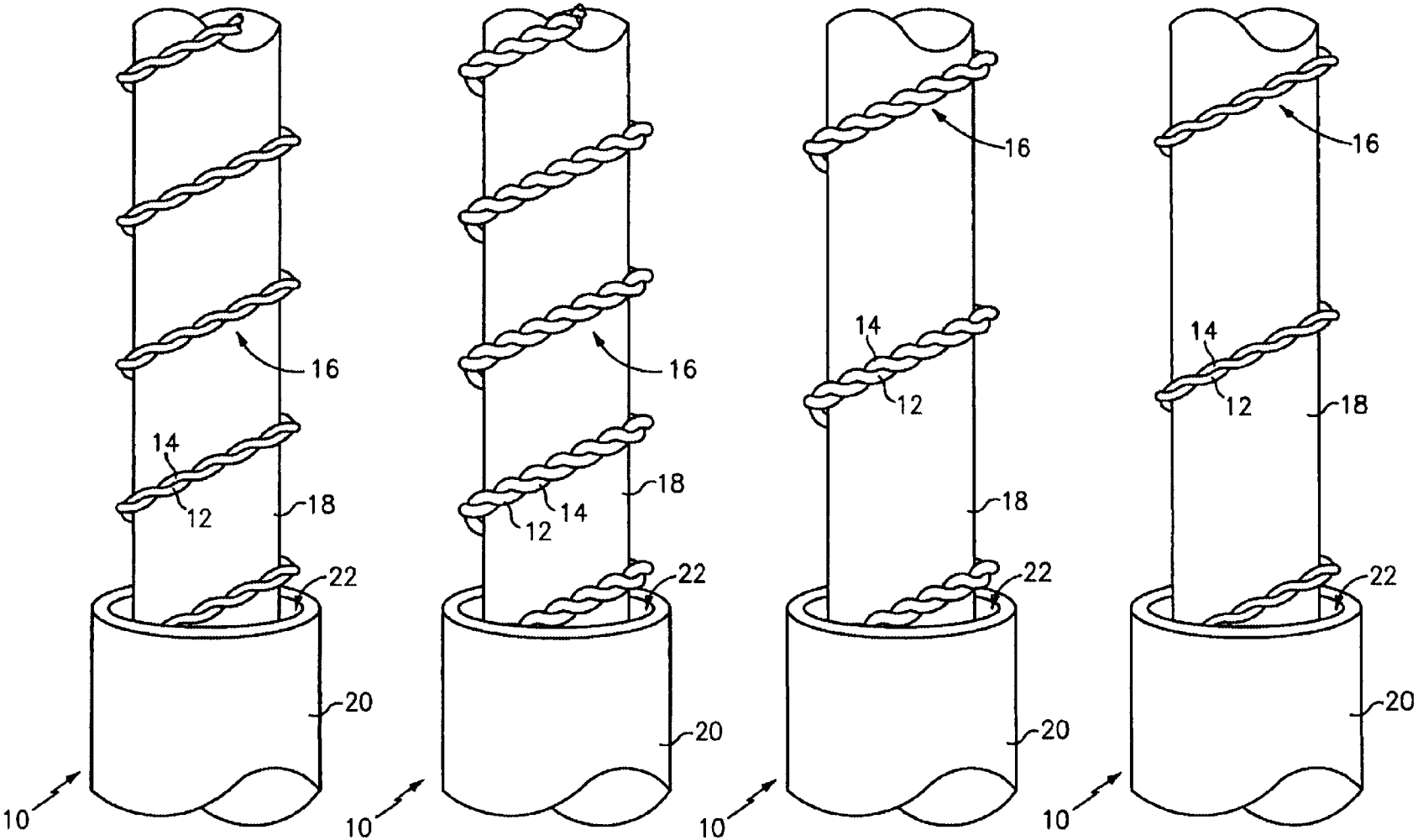
FIG. 5 is a perspective view of the insulated cable of FIG. 3.
FIG. 6 is a perspective view of a second embodiment of the insulated cable of FIG. 3.
FIG. 7 is a perspective view of a third embodiment of the insulated cable of FIG. 3.
FIG. 8 is a perspective view of a fourth embodiment of the insulated cable of FIG. 3.

Various embodiments of the present invention are shown in FIGS. 5–8, with the cables shown therein having different wrap and twist pitches for purposes of illustrating how one pitch can be changed independently of the other in order to modify the effective dielectric constant. For example, given that the insulator wrap 16 is wound around the conductor at a particular wrap pitch, depicted in FIGS. 5 and 6 (or FIGS. 7 & 8), using an insulator wrap with a lower twist pitch (FIG. 6 or FIG. 7) will result in much more insulator material being in the air space 22 than if the conductor were wound with an insulator wrap having a higher twist pitch (FIG. 5 or FIG. 8). Correspondingly, given an insulator wrap with a particular twist pitch, depicted in FIGS. 6 and 7 (or FIGS. 5 & 8), tightly wrapping the conductor with the insulator wrap (FIG. 6 or FIG. 5) will result in much more insulator material being in the air space 22 than a more loosely wrapped conductor (FIG. 7 or FIG. 8). Thus, even if the insulator wrap has to be wound about the conductor at a particular pitch, the effective dielectric constant of the resulting insulator system can still be modified by providing an insulator wrap having a tighter twist or a looser twist, as desired.

The ability to adjust or minimize the effective dielectric constant of the insulator system of the present invention is limited by cable structural requirements. Such structural requirements include cable durability, the degree to which cables need to bend, stiffness requirements (for bending may effect the cable's electrical properties), cable pressure requirements (especially for bundled cables), and cable uniformity requirements (e.g., whatever internal structure is necessary to ensure that the per unit length characteristics of the cable are uniform). In the present invention, structural support depends both on the twist pitch (how tightly the filaments 12, 14 are twisted together) and the wrap pitch (the pitch of the wrap 16 about the conductor 18), as will now be explained in more detail.

Figure 10:
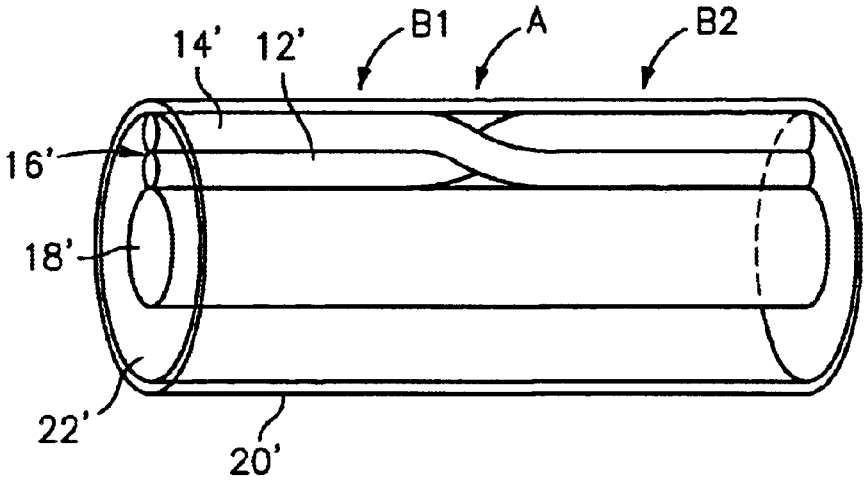
FIG. 10 is a side conceptual view of a theoretical cable illustrating a structural feature of the present invention.

As previously mentioned, the insulator sheath 20 is offset from the conductor 18 and is supported by the support wrap 16. Because the filaments 12, 14 are helically twisted together, the sheath 20 will not be supported by the entirety of the support wrap 16. This is best illustrated in FIG. 10, which shows a conceptual cable structure. Since FIG. 10 is for explanatory purposes only, and is not considered an embodiment of the present invention, elements otherwise similar are designated with primes (e.g., 20').

In FIG. 10, a sheath 20' is supported by a wrap 16' in a longitudinal manner. That is, the wrap runs along one side only of a conductor 18' and has an infinite pitch. Additionally, the wrap's two filaments 12', 14' are twisted together once at a location A. As can be seen, the wrap 16' contacts and supports the sheath 20' at two regions B1 and B2. However, at region A, the wrap touches neither the conductor 18' nor the sheath 20', and therefore does not support the sheath. Considering this geometrical effect, it should be appreciated that a helically twisted wrap will not support the sheath along its entire length.

Figure 11:
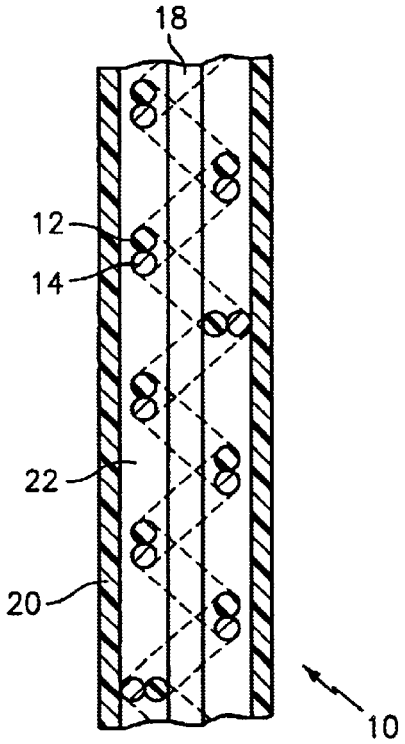
FIG. 11 is a longitudinal cross section view of the cable of FIG. 5.
Figure 12:
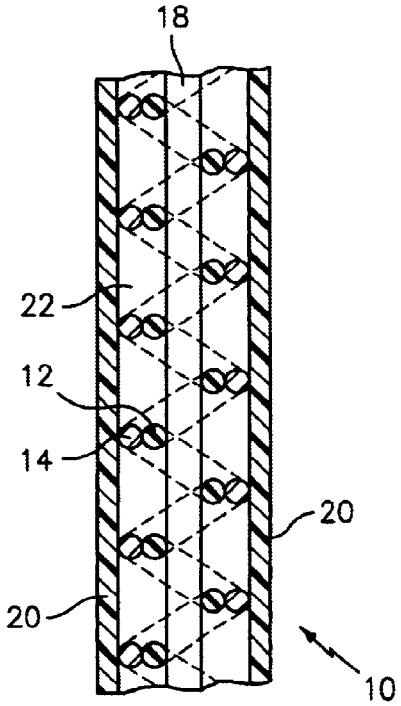
FIG. 12 is a longitudinal cross section view of the cable of FIG. 6.
Figure 13:
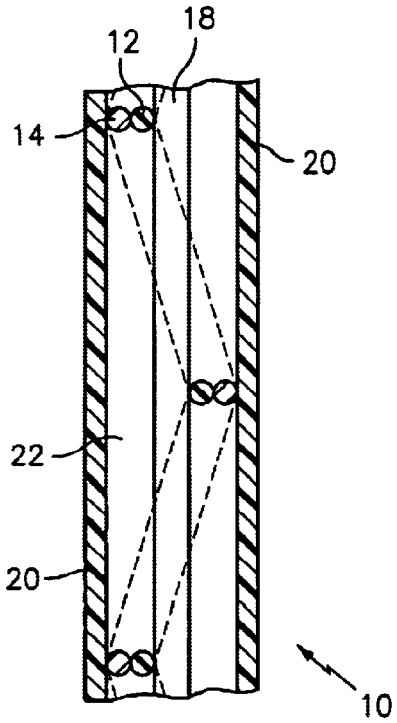
FIG. 13 is a longitudinal cross section view of the cable of FIG. 7.
Figure 14:
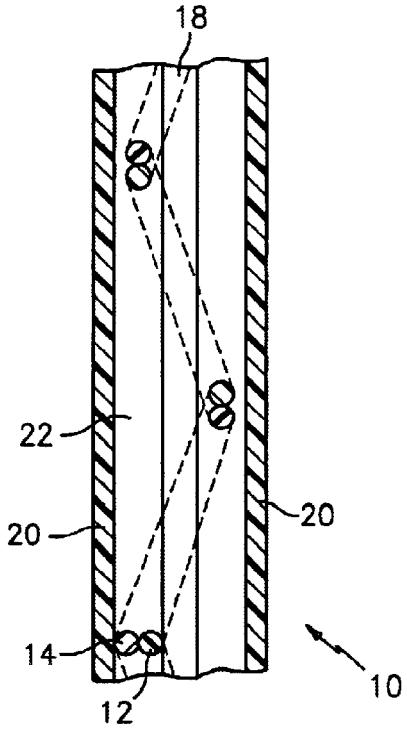
FIG. 14 is a longitudinal cross section view of the cable of FIG. 8.

More specifically, the wrap 16 will only provide a limited number of support locations. The number of support locations will depend on the twist pitch and the wrap pitch, as best shown in FIGS. 11–14, which correspond to FIGS. 5–8 respectively. It should be noted that since FIGS. 11–14 are cross-sectional views, they do not necessarily show the exact number of support locations per unit length, i.e., the support locations will not always be 180 degrees apart. With respect to the twist pitch, the less the pitch (the tighter the twist), the more the potential support locations, because the wrap will twist back on itself in shorter lengths. With respect to the wrap pitch, the less the pitch (the tighter the wrap), the greater the length of wrap around the conductor, and the greater the number of support locations. For example, in FIG. 12 both the wrap pitch and the twist pitch are low. This provides a large number of support locations. In FIG. 14, however, both the wrap pitch and the twist pitch are high, and there are very few support locations. In FIG. 11 the wrap pitch is low and the twist pitch is high (vice versa in FIG. 13), and there is a correspondingly intermediate number of support locations.

To summarize:

$$(\#\text{ support locations})/(\text{unit length conductor})=((\text{length wrap})/(\text{unit length conductor}))\cdot((\#\text{ support locations})/(\text{unit length wrap}))$$

where $$(\text{length wrap})/(\text{unit length conductor})=f(\text{wrap pitch});\text{ and}$$

$$(\#\text{ support locations})/(\text{unit length wrap})=f(\text{twist pitch}).$$

Thus, in manufacturing a cable according to the present invention, one must take into account the structural limitations of the particular application (which will determine the number of support locations necessary per unit length of cable), the desired effective dielectric constant of the insulator system, and, of course, other geometrical or material considerations that will effect other cable characteristics such as impedance. For example, to provide the fastest cable possible (i.e., one having an insulator system with the lowest possible effective dielectric constant), the twist and wrap pitches should be as steep as possible. However, as explained, the pitches cannot be too steep or there will not be enough support. Therefore, one would use the steepest pitches that would still provide enough structural stability, as determined via bending tests, flexing tests, and other mechanical performance tests, as desired and appropriate and depending on the particular application.

To vary the effective dielectric constant of the insulator system above the minimum value, one or both of the pitches would be lowered to increase the amount of wrap material in the space between the conductor and insulator sheath, as described above. Of course, lowering either pitch below a maximum allowable value, as set forth above, would increase the number of support points and the structural stability.

Finally, it should be remembered that both the wrap pitch and the twist pitch have minimum values. With respect to the former, the minimum, least steep pitch is the pitch at which successive coils of wrap finally come into contact. With respect to the latter, the minimum pitch is governed by the material properties of the filaments, that is, the point at which the filaments, if twisted any tighter, would break.

As should be appreciated by those with skill in the art, the ability to adjust the effective dielectric constant of a cable, and therefore its signal propagation speed, can have many uses. For example, in the field of audio electronics, accurate sound reproduction is very important, especially in high end systems. Interconnection cables must be capable of accurately delivering signals by ensuring that low frequency portions do not arrive out of phase from high frequency portions. With the teachings of the present invention, this can be accomplished by providing a dual insulated conduc tor cable, with a first conductor having a higher dielectric constant than the second. The first conductor is used to carry higher frequency signals, which are correspondingly slowed down (as a result of the first conductor having a higher dielectric constant) to meet the speed of the low frequency signals carried by the second conductor.

ohm characteristic impedance coaxial cable, made according to the present invention (see the preferred component values for the "50 Ohm Coax" cable given in Table 2 below), vary according to part tolerances. The values given are averages of various test studies for the stated parameters, with non-stated parameters remaining constant.

TABLE 1

Summary of Mechanical Tolerances vs. Electrical Tolerances

| Parameter | Change 1 (inches) | Impedance Change (ohms) | Propagation Delay Change (ps/ft) | Change 2 (inches) | Impedance Change (ohms) | Propagation Delay Change (ps/ft) |
|---|---|---|---|---|---|---|
| Core* OD | ±0.0005" | ±0.74 | ±3.6 | ±0.001" | ±1.49 | ±7.7 |
| Core ID | ±0.0005" | | | ±0.001" | | |
| Core OD | ±0.0005" | ±0.46 | ±2.5 | ±0.001" | ±0.92 | ±5.0 |
| Core Wall** | ±0.00025" | | | ±0.0005" | | |
| Core Wall | ±0.00025" | ±0.29 | ±6.4 | ±0.0005" | ±0.57 | ±12.8 |
| Core ID | ±0.0005" | | | ±0.001" | | |
| Filament Diameter | ±0.00025" | ±0.19 | ±4.2 | ±0.0005" | ±0.38 | ±8.5 |
| Filament Wrap Lay | ±0.005" | ±0.035 | ±0.90 | ±0.010" | ±0.08 | ±0.17 |
| Filament Twist Lay | ±0.005" | ±0.01 | ±0.20 | ±0.010" | ±0.020 | ±0.45 |

*"Core" refers to the insulator sheath 20;
**"Core Wall" refers to the thickness of the insulator sheath.

The insulator materials for both the filaments and the insulator sheath do not have to be the same. Suitable materials include polyolefin, fluoropolymer, polyvinyl chloride, and other plastics, and the materials can be chosen to further modify the dielectric constant or other characteristics of the insulator system.

Also, although the cable of the present invention has been illustrated without terminating connectors, one of ordinary skill in the art will appreciate that the cable could be provided with terminating connectors, without departing from the spirit and scope of the invention.

Also, although the present invention has been illustrated as having a solid insulator sheath, one of ordinary skill in the art will appreciate that a split or non-uniformly solid insulator sheath could be provided instead, without departing from the spirit and scope of the invention.

Also, although the present invention has been illustrated as having insulator filaments with circular radial cross sections, one of ordinary skill in the art will appreciate that filaments having different cross sections could be used without departing from the spirit and scope of the invention. For example, both filaments could be provided with one or more shallow, longitudinal grooves, or they could be partially hollow.

As mentioned above, the electrical characteristics of a cable are interdependently determined, in part, by component dimensions and variances thereof. Thus, variances in cable component dimensions along the length of a cable can affect, e.g., signal propagation speed and the cable's characteristic impedance, resulting in impedance mismatches and increased return loss. Accordingly, the components of the coaxial cable(s) of the present invention have very tight manufacturing or dimensional tolerances, which results in the cable having very tight electrical tolerances and enhanced performance (low return loss, high speed, high bandwidth, etc.)

The following table illustrates how the propagation delay (in units of picoseconds per foot) and impedance of a 50

By way of explanation, for example, the study examining variances in "Core OD" and "Core ID" (row 1) represents a scenario where the insulator sheath has the proper wall thickness, but is extruded either too tight or too loose, i.e., there are variances in the inner diameter ("ID") and/or outer diameter ("OD") of the insulator sheath 20 with respect to the central conductor, along the cable's length. As should be appreciated, with a diameter error of only ±0.0005" the impedance error is about ±0.75 ohms, while with a diameter error of ±0.001" the impedance error is about ±1.5 ohms and the propagation speed error is around ±7.7 ps/ft. It can also be noted that the effect of some parameter variations are greater on the propagation speed values and others are greater on the impedance values, therefore these relative variations must be considered as a whole.

The study given above is essentially based on the variation of one parameter at a time and that parameter's effect on impedance and propagation speed. In practical applications, more than one parameter may vary at the same time, resulting in cumulative effects on the impedance and propagation speed values. This necessitates the tight control of all variables.

The effect of changes in the filament twist lay and the filament wrap lay are very small on the resulting impedance and propagation speed values. Therefore these parameters can be used to primarily provide the required structural support of the core tube, i.e. prevent crushing of the tube or migration of the conductor off center. Proper tensioning control of these small filaments during twisting and wrapping, however, is still necessary to prevent loose filaments and/or crushed filaments. These errors have the same effect as variations in the extruded filament diameters. Therefore the filaments must not be distorted as the insulator sheath is being extruded over them, which can be facilitated by having the melt temperature of the filaments and insulator sheath materials be different. (For example, the high speed and small size of the coaxial cable of the present invention requires the exclusive use of low-dielectric materials for the filaments and insulator sheath. Thus, the filaments use a material with a high melt temperature such as PFA and the insulator sheath uses a material with a lower melt temperature such as FEP so as not to melt the filament during the core tube extrusion.)

In light of the above, and as determined experimentally, to maximize performance for high-speed, high-bandwidth applications, and to provide a coaxial cable having a very low tolerance characteristic impedance (e.g., of ±1 ohm for a 50 ohm cable), certain components in the coaxial cable of the present invention are provided according to very close manufacturing tolerances, as follows: insulator sheath OD and ID tolerance=±0.0005"; insulator sheath wall thickness tolerance=±0.00025"; and filament diameter tolerance=±0.00025". The following table shows preferred component values for three cables having standard characteristic impedances (50 ohms, 75 ohms, and 100 ohms), which have been found to result in an ultra-fast and ultra-small coaxial cable with enhanced electrical properties:

TABLE 2

Cable Electrical and Mechanical Properties

| Property | 50 Ohm Coax | 75 Ohm Coax | 100 Ohm Twinax |
|---|---|---|---|
| Impedance | 50 ohms | 75 ohms | 100 ohms |
| Tolerance | ±1 ohm | ±3 ohms | ±5 ohms |
| Propagation Speed | 1.14 ns/ft nominal | 1.14 ns/ft nominal | 1.14 ns/ft nominal |
| Tolerance | ±0.01 ns/ft | ±0.01 ns/ft | ±0.01 ns/ft |
| Capacitance | 22.5 pF/ft nom | 15.0 pF/ft nom | 11.4 pF/ft nom |
| Bandwidth | Up to 20 GHz | Up to 20 GHz | Up to 20 GHz |
| Central Conductor range | 32 AWG to 22 AWG | 34 AWG to 16 AWG | 32 AWG to 22 AWG |
| Filament Size range | 0.0025" to 0.010" | 0.003" to 0.025" | 0.0025" to 0.010" |
| Filament Tolerance | ±0.00025" | ±0.0025" | ±0.0025" |
| Filament Twist Pitch | 11 × Filament Diameter | 11 × Filament Diameter | 11 × Filament Diameter |
| Filament Wrap Pitch | 20 × Filament Diameter | 20 × Filament Diameter | 20 × Filament Diameter |
| Insulator Sheath Size Range (ID & OD) | 0.020" to 0.075" | 0.030" to 0.200" | 0.020" to 0.075" |
| Insulator Sheath Tolerance (ID & OD) | ±0.0005" | ±0.0005" | ±0.0005" |
| Insulator Sheath Wall Thickness* | 0.005" | 0.005" | 0.005" |
| Insulator Sheath Wall Thickness Tolerance | ±0.00025" | ±0.00025" | ±0.00025" |

*Insulator sheath thickness can vary from application to application; 0.005" is an example value of one commonly-used, suitable thickness.

Figure 15:
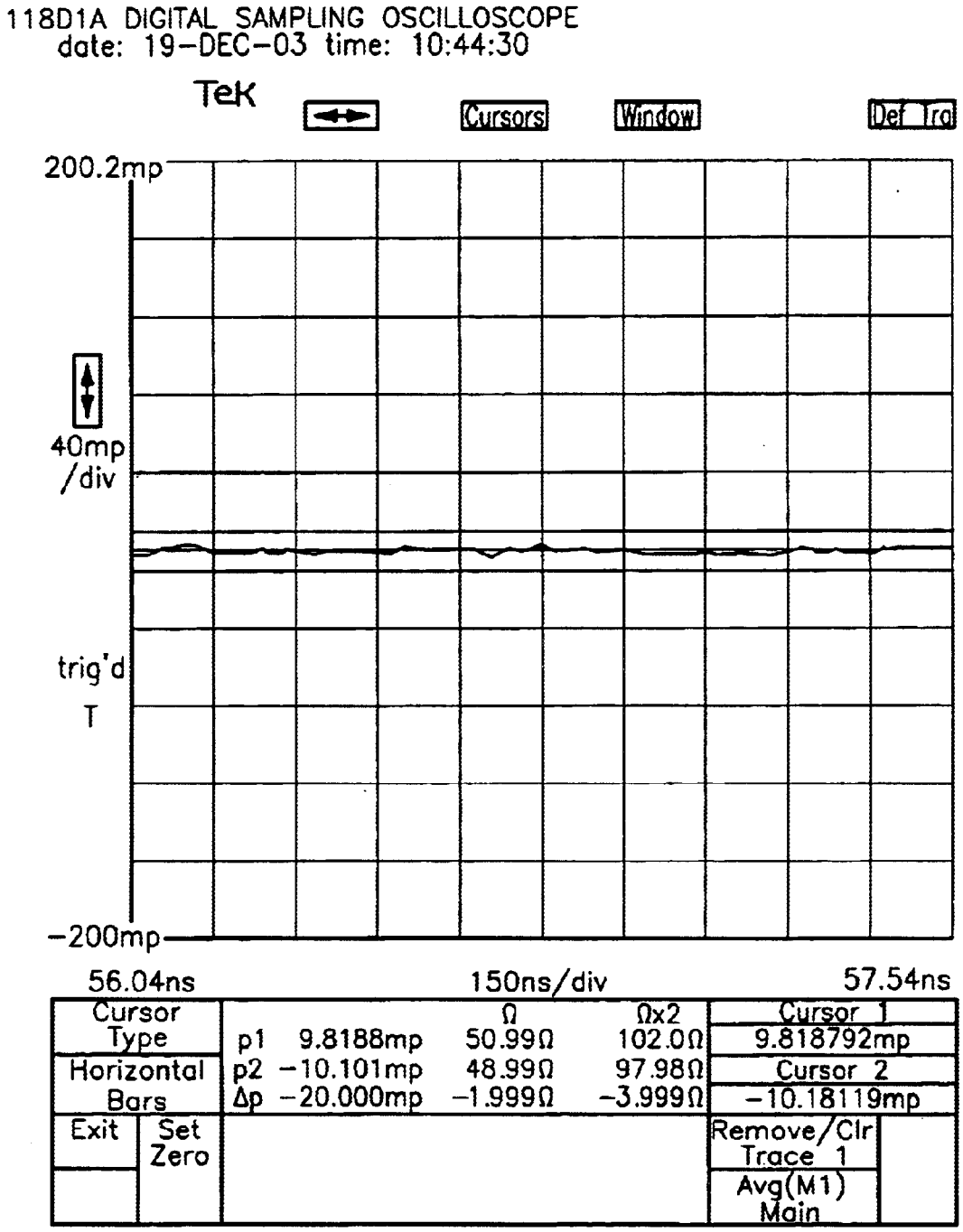
FIG. 15 shows a plot of the measured characteristic impedance of a 50 ohm coaxial cable according to the present invention.

FIG. 15 shows a plot of the measured characteristic impedance of a 50 ohm coaxial cable according to the present invention, i.e., as given above in Table 2. The plot was taken with a with a Tektronix 11801A Digitizing Oscilloscope with SD24 TDR sampling heads. Each trace is displayed with horizontal cursors above and below the measured trace indicating an acceptable tolerance window as well as the overall linearity of the impedance 1o profile. Both the horizontal and vertical scales are identical in all traces. As should be appreciated, the characteristic impedance is within a ±1 ohm window (tolerance). Note that the vertical scale is expanded to show the linearity of the impedance profile, and that there is less than 0.5 ohm variability over the displayed length.

Figure 16:
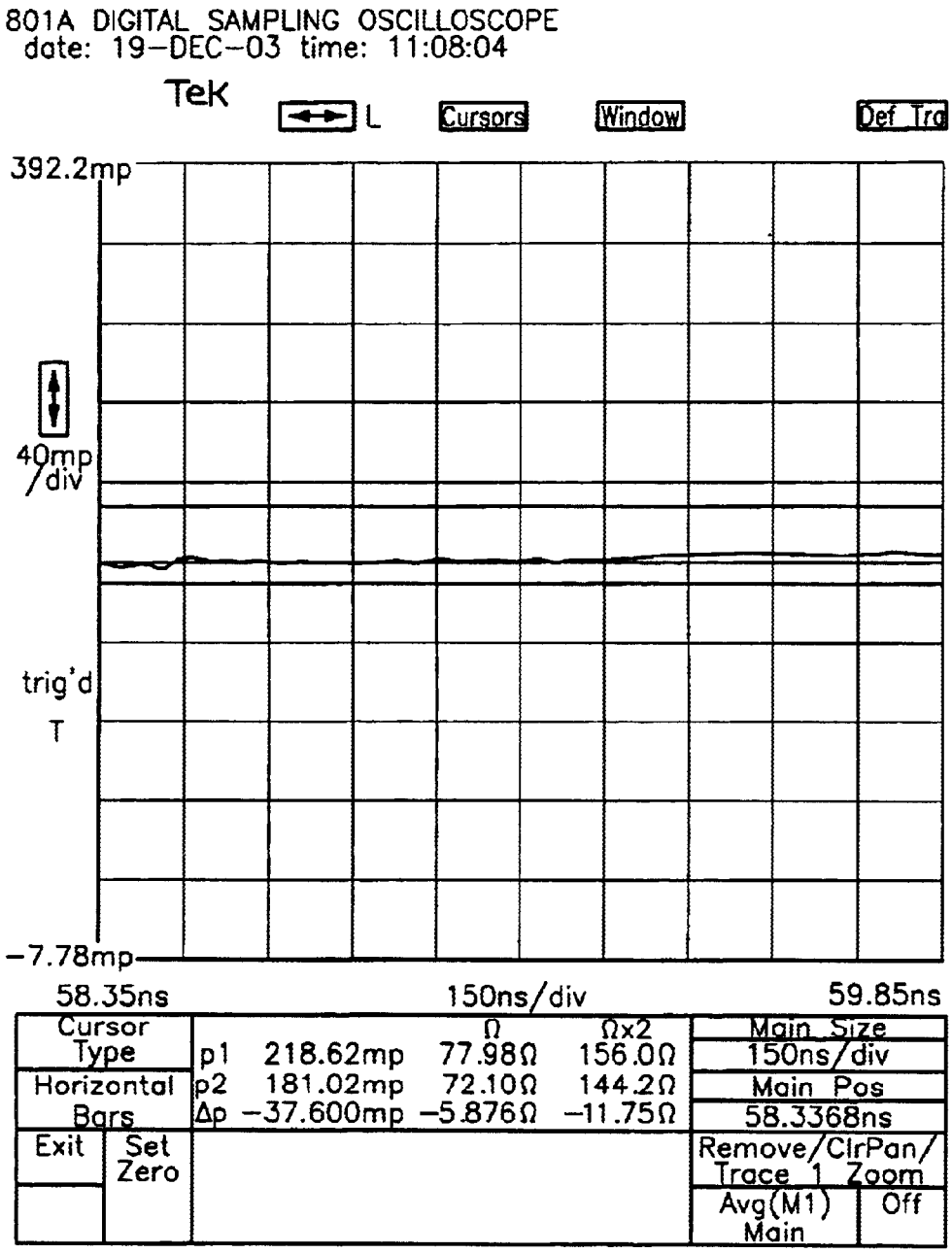
FIG. 16 shows a plot of the measured characteristic impedance of a 75 ohm coaxial cable according to the present invention.

Similarly, FIG. 16 shows a plot of the measured characteristic impedance of a is 75 ohm coaxial cable according to the present invention, i.e., as given in Table 2 above. Note that the impedance is within a ±3 ohm window. Again, the vertical scale is expanded to show the linearity of the impedance profile. There is less than 0.5 ohm variability over the displayed length.

Figure 17:
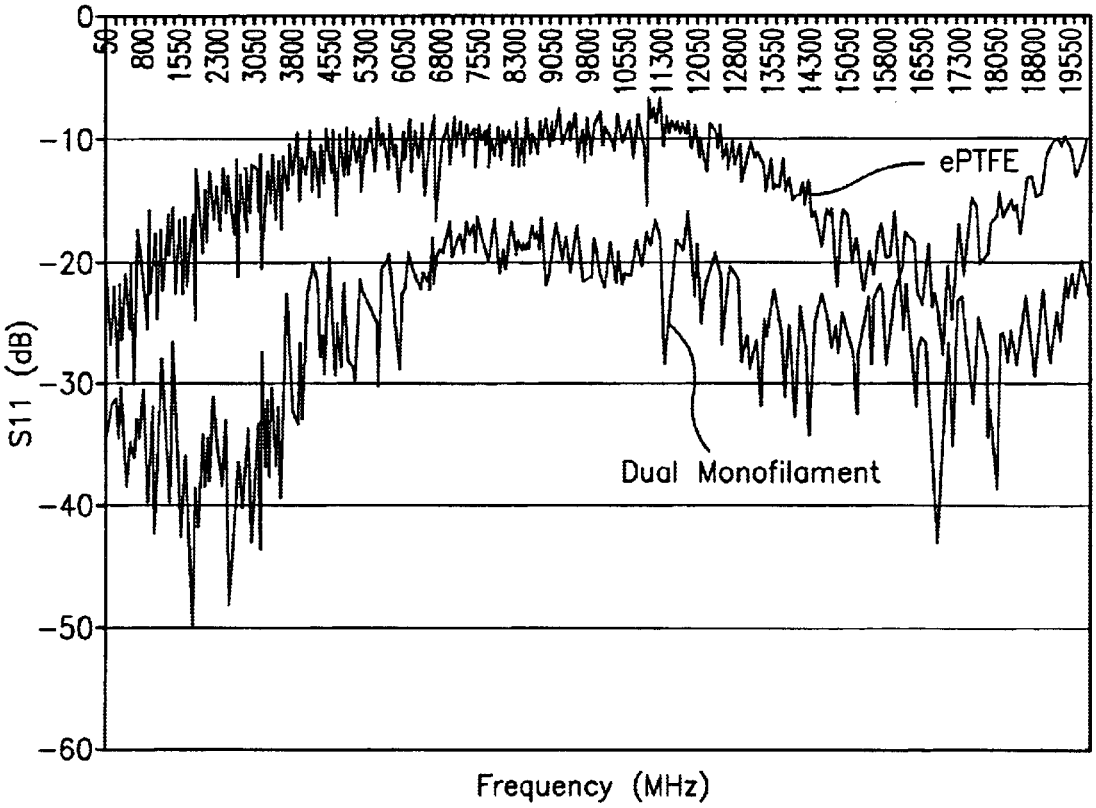
FIG. 17 shows a plot of the measured return loss for a 50 ohm coaxial cable according to the present invention versus a standard coaxial cable.
Figure 18:
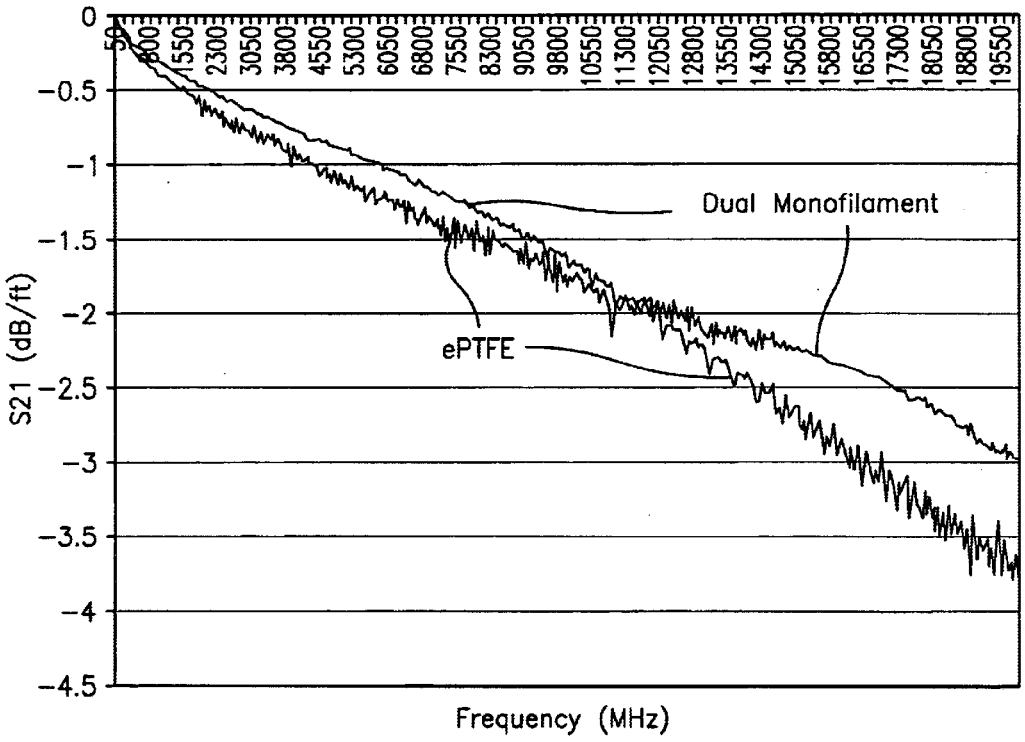
FIG. 18 shows a plot of the measured insertion loss for the two cables in FIG. 17.

FIGS. 17 and 18 are plots of the scattering parameters for a 50 ohm coaxial cable according to the present invention versus a standard 50 ohm coaxial cable, taken with an Agilent 8720ES Vector Network Analyzer. The standard coaxial cable utilizes expanded PTFE as a dielectric. FIG. 17 compares the return loss (scattering parameter, S11) for the two cables. The top trace (labeled "ePFTE") is the expanded PTFE cable and the bottom trace (labeled "dual monafilament") is the dual filament coaxial cable of the present invention. The latter has nearly 10 dB better return loss across a bandwidth from 50 MHz to 20 GHz. FIG. 18 compares the insertion loss (scattering parameter, S21) for the two coaxial cables. The bottom trace is the expanded PTFE cable and the top trace is the present cable. The latter has less attenuation across a bandwidth from 50 MHz to 20 GHz.

Since certain changes may be made in the above described insulated cable, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Having thus described the invention, what is claimed is:

1. An ultra-small, high-speed 50 ohm coaxial cable comprising:

a. a longitudinal conductor having a diameter of 0.008" to 0.0253";

b. a support wrap helically wound about the conductor according to a wrap pitch and comprising first and second insulator filaments helically twisted together according to a twist pitch, wherein the filaments each have a diameter of 0.0025" to 0.010" and a tolerance of ±0.00025";

c. an insulator sheath at least partially covering the support wrap and the conductor, wherein: the insulator sheath has an inner diameter of 0.020" to 0.075" and an inner diameter tolerance of ±0.0005"; the insulator sheath has a wall thickness, and a wall thickness tolerance of ±0.00025"; and the insulator sheath is supported by the support wrap at a particular number of support locations and is thereby offset from the conductor to form an airspace between the conductor and the insulator sheath;

d. a concentric ground shield disposed about an outer periphery of the insulator sheath; and e. a concentric outer insulator jacket disposed about an outer periphery of the concentric ground shield, wherein:

f. the cable has a characteristic impedance tolerance of ±1 ohm.

2. The coaxial cable of claim 1 wherein the cable has a propagation speed of no more than 1.14 ns/ft nominal, a propagation speed tolerance of ±0.01 ns/ft, and a capacitance of no more than 22.5 pF/ft nominal.

3. The cable of claim 1 wherein the insulator sheath wall thickness is 0.005"±0.00025".

4. An ultra-small, high-speed 75 ohm coaxial cable comprising:

a. a longitudinal conductor having a diameter of 0.0063" to 0.0508";

b. a support wrap helically wound about the conductor according to a wrap pitch and comprising first and second insulator filaments helically twisted together according to a twist pitch, wherein the filaments each have a diameter of 0.003" to 0.025" and a tolerance of ±0.0025";

c. an insulator sheath at least partially covering the support wrap and the conductor, wherein: the insulator sheath has an inner diameter of 0.030" to 0.200" and an inner diameter tolerance of ±0.0005"; the insulator sheath has a wall thickness, and a wall thickness tolerance of ±0.00025"; and the insulator sheath is supported by the support wrap at a particular number of support locations and is thereby offset from the conductor to form an airspace between the conductor and the insulator sheath;

d. a concentric ground shield disposed about an outer periphery of the insulator sheath; and e. a concentric outer insulator jacket disposed about an outer periphery of the concentric ground shield, wherein:

f. the cable has a characteristic impedance tolerance of ±3 ohm.

5. The coaxial cable of claim 4 wherein the cable has a propagation speed of no more than 1.14 ns/ft nominal, a propagation speed tolerance of ±0.01 ns/ft, and a capacitance of no more than 15.0 pF/ft nominal.

6. The cable of claim 4 wherein the insulator sheath wall thickness is 0.005"±0.00025".

7. An ultra-small, high-speed cable comprising:

a. a longitudinal conductor;

b. a support wrap helically wound about the conductor according to a wrap pitch and comprising first and second insulator filaments helically twisted together according to a twist pitch, wherein the filaments each have a diameter of 0.0025" to 0.010" and a tolerance of ±0.00025";

c. an insulator sheath at least partially covering the support wrap and the conductor, wherein: the insulator sheath has an inner diameter of 0.020" to 0.075" and an inner diameter tolerance of ±0.0005"; the insulator sheath has a wall thickness, and a wall thickness tolerance of ±0.00025"; and the insulator sheath is supported by the support wrap at a particular number of support locations and is thereby offset from the conductor to form an airspace between the conductor and the insulator sheath;

d. a concentric ground shield disposed about an outer periphery of the insulator sheath; and e. a concentric outer insulator jacket disposed about an outer periphery of the concentric ground shield.

8. The cable of claim 7 wherein the cable has a characteristic impedance of 100 ohms±5 ohms.

9. The cable of claim 7 wherein the insulator sheath wall thickness is 0.005"±0.00025" and the conductor has a diameter of 0.008" to 0.0253".

10. A method of manufacturing a high-speed, ultra-small coaxial cable with a characteristic impedance of 50±1 ohms, said method comprising the steps of:

a. preparing a support wrap by helically twisting together first and second insulator filaments according to a twist pitch, wherein the filaments each have a diameter of 0.0025" to 0.010" and a tolerance of ±0.00025";

b. helically winding the support wrap around a longitudinal conductor according to a wrap pitch, wherein the conductor has a diameter of 0.008" to 0.0253";

c. at least partially covering the support wrap and the conductor with an insulator sheath, wherein: the insulator sheath has an inner diameter of 0.020" to 0.075" and an inner diameter tolerance of ±0.0005"; the insulator sheath has a wall thickness, and a wall thickness tolerance of ±0.00025"; and the insulator sheath is supported by the support wrap at a particular number of support locations and is thereby offset from the conductor to form an airspace between the conductor and the insulator sheath;

d. disposing a concentric ground shield about an outer periphery of the insulator sheath; and e. disposing a concentric outer insulator jacket about an outer periphery of the concentric ground shield.

* * * * *

UNITED STATES PATENT AND TRADEMARK OFFICE

CERTIFICATE OF CORRECTION

PATENT NO. : 6,812,401 B2
DATED : November 2, 2004
INVENTOR(S) : David E. Karrmann It is certified that error appears in the above-identified patent and that said Letters Patent is hereby corrected as shown below:

Column 11,
Line 51, delete “1o”.
Line 59, delete “is”.

Signed and Sealed this

Twenty-second Day of March, 2005

JON W. DUDAS
*Director of the United States Patent and Trademark Office*